United States Patent [19]

Paulie

[11] 4,130,176

[45] Dec. 19, 1978

[54] COMBINATION SAFETY BELT AND SAFETY LINE

[76] Inventor: Roy W. Paulie, 5375 Duke St., Alexandria, Va. 22304

[21] Appl. No.: 897,700

[22] Filed: Apr. 19, 1978

[51] Int. Cl.[2] ..... A62B 1/18; A62B 35/00

[52] U.S. Cl. ..... 182/4; 182/5; 182/191; 254/154

[58] Field of Search ..... 182/4, 5, 6, 7, 191, 182/193; 254/155, 154, 151, 150 R

[56] References Cited

U.S. PATENT DOCUMENTS

| | | | |
|---|---|---|---|
| 195,354 | 9/1877 | Eyler | 254/154 |
| 272,129 | 2/1883 | Edmonds | 254/154 |
| 484,042 | 10/1892 | Murphy | 182/5 |
| 580,961 | 4/1897 | Steimann | 254/154 |
| 775,704 | 11/1904 | Howe | 254/154 |
| 791,921 | 6/1905 | Luse | 254/154 |
| 1,041,090 | 10/1912 | Johnson | 254/154 |
| 1,782,951 | 11/1930 | Abbott | 182/6 |
| 2,166,777 | 7/1939 | Walker | 182/4 |
| 2,576,755 | 11/1951 | Gaskin | 254/154 |
| 2,626,126 | 1/1953 | Sasgen | 254/151 |

*Primary Examiner*—Reinaldo P. Machado
*Attorney, Agent, or Firm*—Gilbert L. Wells

[57] ABSTRACT

A safety belt for preventing injury to persons working in high places. The belt has straps for attachment to a window frame, scaffold or derrick or other supporting surface such as a ship's deck or hull. A housing secured to the forward portion of the belt is provided with a shaft on which is wound a line attachable to the window ledge, scaffold, derrick, boat deck or hull. A mechanism for lifting the user back to the supporting surface in the event of strap failure is associated with the shaft. The lifting mechanism is operable by the user.

5 Claims, 6 Drawing Figures

COMBINATION SAFETY BELT AND SAFETY LINE

BACKGROUND OF THE INVENTION

The invention relates to safety devices in general and in particular to a safety device for persons working in high places that will prevent the persons from falling.

An important object of the invention is to provide a safety belt including, in addition to straps for attachment to a window frame, scaffold, derrick, etc., a safety line wound upon a shaft and mounted in a housing which is secured to the safety belt.

Yet another object of the invention is to provide means in the safety belt enabling the user to lift himself back to the original level from which he might descend in the event of a fall.

A further object of the invention is to provide such a device which can be attached to a boat, deck or rail to permit persons from accidentally falling into water and to raise themselves back to safety.

Still another object of the invention is to provide such a device which is simple and practical in construction, strong and reliable in use and efficient and durable in operation.

BRIEF DESCRIPTION OF THE DRAWINGS

These and other objects of the invention will become apparent from the following description in connection with the appended drawing illustrating a preferred embodiment of the invention, wherein.

DESCRIPTION OF THE PREFERRED EMBODIMENTS

Figure 1:
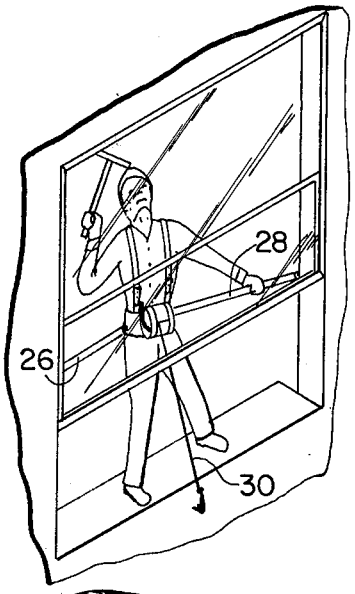
FIG. 1 illustrates one use of the sefety belt device.
Figure 2:
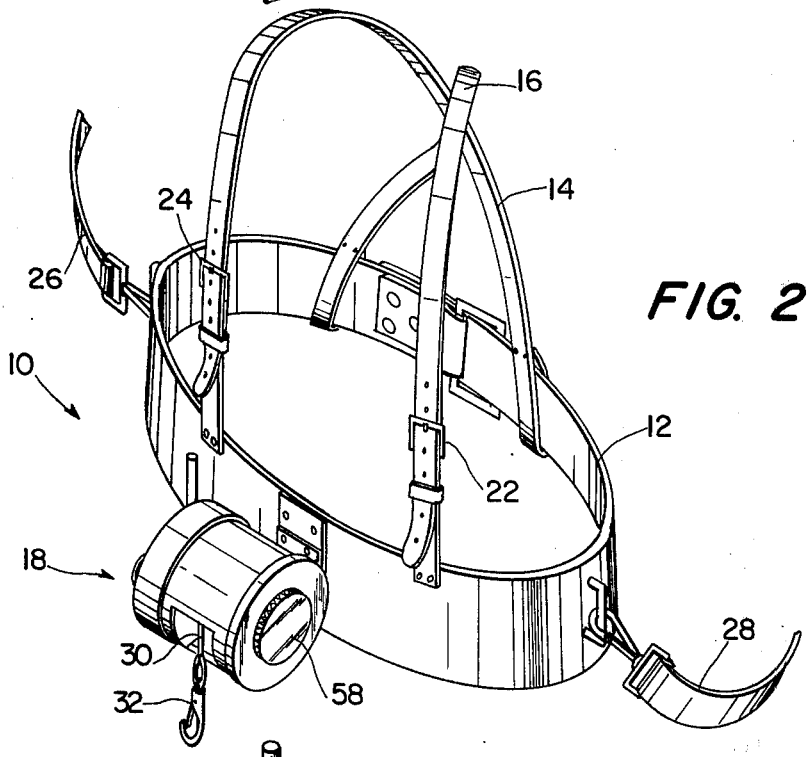
FIG. 2 is a perspective view of the safety belt.
Figure 3:
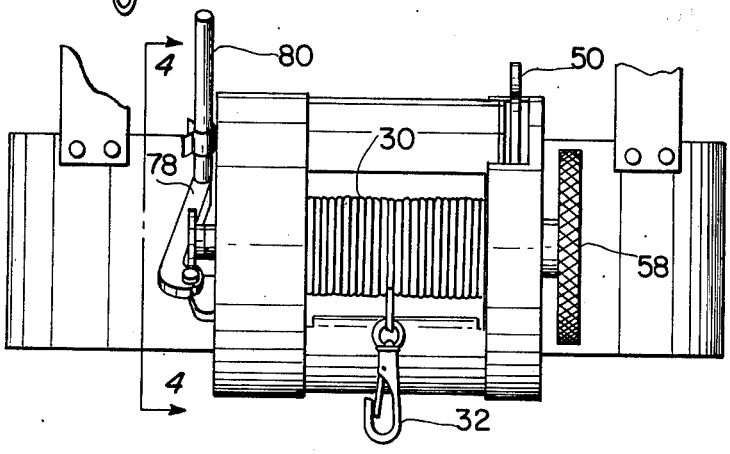
FIG. 3 is a front elevational view of the safety belt.
Figure 4:
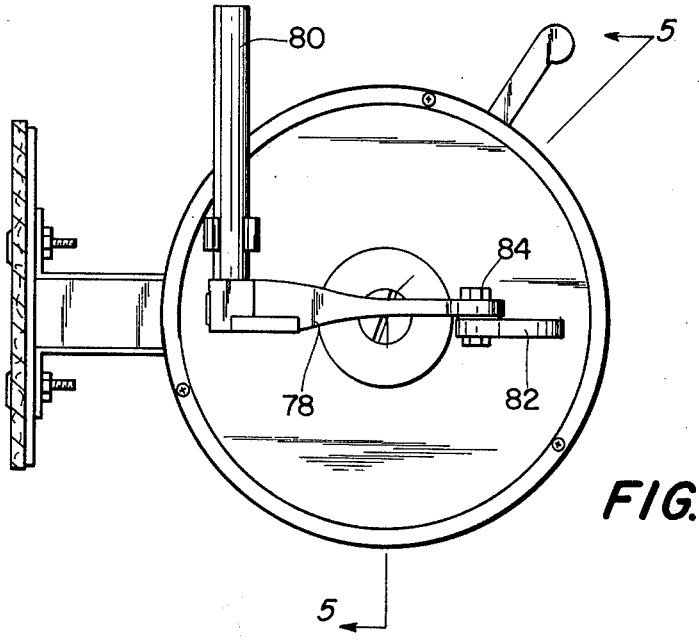
FIG. 4 is a side view taken on line 4—4 of FIG. 3.

With particular reference to FIG. 2, the safety belt is generally indicated by the numeral 10. The safety belt has a waist belt 12 and crossed shoulder straps 14 and 16. The winding mechanism generally indicated as 18 is attached to waist belt 12 with suitable fasteners such as bolts and nuts, rivets, etc. The waist belt 12 is provided with a buckle 20 while shoulder straps 14 and 16 are provided with buckles 22 and 24 respectively. Straps 26 and 28 are connected to the sides of waist belt 12 and the other ends of the straps are attached to a window frame as shown in FIG. 1.

Line 30 having a hook 32 is unwound from winding mechanism 18 and the hook 32 is secured inside or to the building. Line 30 can be any high tensile strength nylon cord, steel cable, etc.

Figure 5:
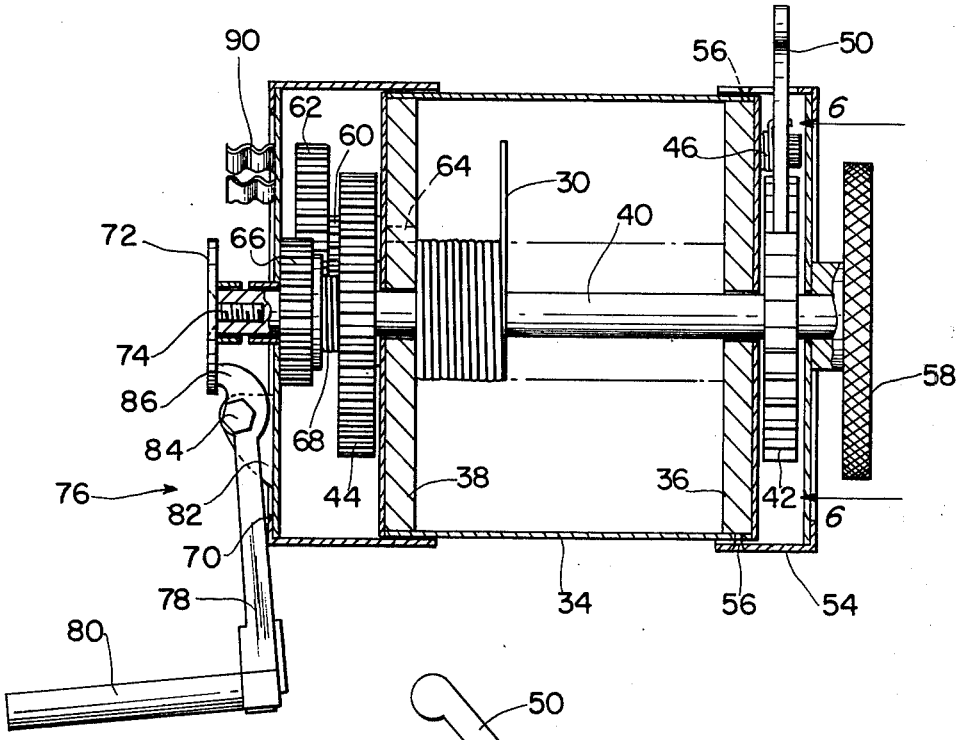
FIG. 5 is a sectional view of the device taken on line 5—5 of FIG. 4 showing the hand crank engaged.

FIG. 5 shows the inner components of the winding mechanism 18. The winding mechanism has a housing 34 with sides 36 and 38. Shaft 40 is rotatably mounted in sides 36 and 38. Pawl gear 42 is secured at the end of shaft 40 on the outside of side 36 and gear 44 is secured to shaft 40 on the outside of side 38.

Figure 6:
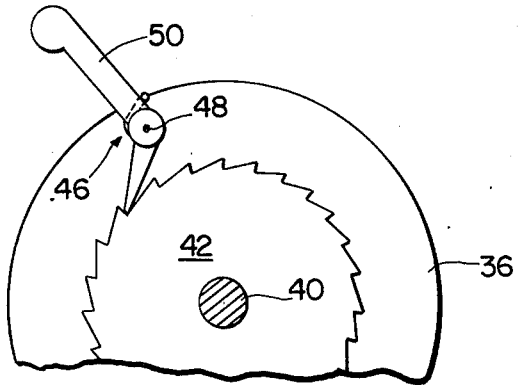
FIG. 6 is a side view and partial section of the device along the line 6—6 of FIG. 5.

As particularly shown in FIG. 6, ratchet wheel 42 is engaged by pawl 46 mounted on pin 48 and having handle 50. Pawl 46 is biased against ratchet wheel 42 by leaf spring 52.

A cover 54 is secured to housing 34 by screws 56 and covers the ratchet mechanism. A knob 58 is secured to shaft 40 outside the cover 54.

Pinion gear 60 and gear 62 are secured to one another and are rotatably mounted on shaft 64. Pinion 60 engages gear 44.

A second pinion gear 66 is rotatably mounted on shaft 40 and is biased away from engagement with gear 62 by coil spring 68. Cover 70 is secured to pinion gear 66 and rotates therewith. The cover 70 and pinion gear 66 are held in rotatable position at the end of shaft 40 by cap 72 which is secured to the shaft by screw 74.

Folding handle 76 has a lower lever portion 78 with a pivoted hand portion 80. Lever portion 78 is mounted on cover 70 at 82 and rotates about pin 84. When lever 78 is pivoted against cover 70, the lever point 86 engages the inside of cap 72 and as a result cover 70 with pinion gear 66 are forced into engagement with gear 62.

Hand portion 80 is pivoted for folding at 88 and when folded is secured to cover 70 by U-shaped spring fastener 90.

Best Mode of Using the Apparatus

In using the apparatus of the present invention to wash windows, the hook 32 is secured to the inside of a building such as a steam radiator line. Line 30 is then played out by moving handle 50 to release the pawl from the ratchet. In order to tighten the line 30 without a load thereon, handle 50 is released and knob 58 is turned.

The user is then ready to go out the window and stand on the ledge. Outside the window the user hooks straps 26 and 28 to the window frame.

If straps 26 and 28 become disconnected or break, the user will fall below the level of the window sill but safety line 30 secured within the building will halt the fall.

The user then unfolds handle 76 from the side of the winding mechanism and reels himself back to the window sill and enters the window.

I claim:

1. A safety belt comprising, in combination, a waist belt, a pair of straps secured to said waist belt for attaching said belt to a supporting surface, a housing secured to said belt intermediate said belt portions, said housing having first and second side walls, a shaft rotatably mounted intermediate said side walls and having first and second ends extending through and beyond said side walls, a safety line wound on said shaft, said safety line having one end secured to said shaft and another end provided with a hook for attaching said cord to a supporting surface and means for winding said safety line on said shaft, comprising a ratchet wheel mounted intermediate said first end engaging a pawl pivoted on said first side wall, a hand wheel attached to said first end, gear reduction means intermediate said second end and a hand crank on said second end.

2. The safety belt of claim 1, wherein said gear reduction means comprise a first gear mounted on said shaft outside said second side wall, a second gear and a first pinion gear fixed to one another and mounted for rotation on said second side wall, said first pinion gear engaging said first gear, a first cover and second pinion gear secured to one another and mounted on said shaft intermediate said second end, a coil spring surrounding said shaft and positioned between said first gear and said second pinion gear, a cap secured to said second end and retaining said first cover on said shaft, said hand crank comprising a lever portion pivoted on said first cover engaging the inside of said cap and forcing said first cover and said second pinion gear against the pressure of said coil spring and into engagement with said second gear.

3. The safety belt of claim 1, wherein said hand crank has a pivoted hand portion and a U-shaped spring fastener is mounted on said first cover for retaining said hand crank is folded condition.

4. The safety belt of claim 3, wherein a second cover is located between said ratchet and said hand wheel and is secured to said first side wall.

5. The safety belt of claim 4, further comprising crossed shoulder straps connected to said waist belt.

* * * * *